US008267762B2

(12) United States Patent
Wisler et al.

(10) Patent No.: US 8,267,762 B2
(45) Date of Patent: Sep. 18, 2012

(54) FASTER PLAY CARD GAMES

(75) Inventors: James M. Wisler, Littleton, CO (US); Jeff Chun-sheng Wu, Lone Tree, CO (US)

(73) Assignee: Masque Publishing, Inc., Lone Tree, CO (US)

( * ) Notice: Subject to any disclaimer, the term of this patent is extended or adjusted under 35 U.S.C. 154(b) by 194 days.

(21) Appl. No.: 12/720,262

(22) Filed: Mar. 9, 2010

(65) Prior Publication Data

US 2011/0221133 A1 Sep. 15, 2011

(51) Int. Cl.
*A63F 1/00* (2006.01)
*A63F 13/00* (2006.01)

(52) U.S. Cl. ..... 463/12; 463/13; 463/46; 273/292; 273/274; 273/309; 273/138.2

(58) Field of Classification Search ..... 273/292, 273/274, 309, 138.2, 138.1; 463/12, 13, 463/46

See application file for complete search history.

(56) References Cited

U.S. PATENT DOCUMENTS 5,615,888 A 4/1997 Lofink et al.
5,806,846 A 9/1998 Lofink et al.
6,077,161 A 6/2000 Wisler
6,607,443 B1 * 8/2003 Miyamoto et al. ..... 463/40

* cited by examiner

*Primary Examiner* — Benjamin Layno
(74) *Attorney, Agent, or Firm* — Sheridan Ross P.C.

(57) ABSTRACT

Blackjack and Blackjack-related card games are provided in which the speed of play is increased over the conventional ways these games are played. After the initial cards are provided to each of the players, determinations regarding the order in which players are to receive requested, additional cards are made using a control that communicates with terminals. The player who is determined to be the first to make a request for another card is provided the next additional card(s). Such determinations rely on requests generated by the players using input elements associated with their terminals. For each set of one or more additional cards being requested, one or more players make a request using the player's input element. A number of such sets of requests are typically made until all players are finished receiving requested cards. Accordingly, players do not need to wait until one or more other players have completed their game play before being able to receive their own additional card(s). The order related to being provided additional cards depends on the speed of input requests and not the positions of the players. The modified Blackjack and Blackjack-related games can be played at a table and online.

24 Claims, 7 Drawing Sheets

FASTER PLAY CARD GAMES

FIELD OF THE INVENTION

The present invention relates to enhancing play of certain card games and, in particular, to improving the speed of play for Blackjack table games including derivatives thereof, such as Spanish 21.

BACKGROUND OF THE INVENTION

Blackjack is a highly popular and widely played game, both in casinos and online. Spanish 21 is a card game that is similar in play to Blackjack except that certain cards, such as the tens, are removed from the deck. The removal of these cards allows for desirable rules to be utilized including payouts that are different than Blackjack payouts. Spanish 21 is a patented game and is described in U.S. Pat. No. 5,615,888, which is owned by the assignee of this invention.

Blackjack and Spanish 21 are table games in which cards are dealt to the players and the dealer. Each player's goal is to beat the dealer. The dealer deals an initial two cards to each player in order from the dealer's left to the dealer's right. Each player has an opportunity or turn to make decisions regarding his hand. The player to the leftmost of the dealer, from the dealer's perspective, is the first player to make decisions about his hand. After that player has made all his decisions related to any additional card(s) he receives, then the other players, in turn, make their card decisions, in the same left-to-right order that was used when the initial two cards were dealt. Like the leftmost player, each such player makes all her/his decisions related to any additional card(s) being received by that player before any next player is able to express his or her decision(s) about receiving any additional card(s). After all table players are finished with their hands, the dealer makes decisions about his hand using set rules.

Such a method of play, which is common to both Blackjack and Spanish 21, can contribute to slow play of these games since the next-in-turn players are waiting to express their decisions about their hands while one player, higher in the order of dealt cards, is taking his turn related to receiving any additional card(s). In addition, relatively slow play occurs since each player that has already completed play must wait for any other player who has not completed play before the next round of the game can start. The known method for handling Blackjack and Spanish 21 card decisions has worked well in non-computerized environments. However, with the advance of computerized gaming table implementations, the present invention is able to increase the speed of play for these two table games, as well as any other game based on, derived from or sufficiently related to Blackjack.

SUMMARY OF THE INVENTION

In accordance with the present invention, method and apparatus are provided for playing card games, including Blackjack and Spanish 21, in casinos and/or online in a way that increases the speed of play so that more hands can be played during any particular time, in comparison with conventionally played hands. Referring to the casino embodiment, the apparatus includes a table having a number of units or components which enable players to compete related to the order in which additional cards are dealt or provided to the players. Unlike conventional play, cards requested to be dealt after the initial two cards are provided to each player can be dealt in any order, depending on which player is found to have requested a card first. For example, the leftmost player, from the perspective of the dealer, is the first to receive the first card and then is the first to receive the second card. However, another player, who is not the leftmost player, can receive one or more cards before the leftmost player, which are provided after these initial two cards.

Regarding the requests and the determinations related to which player is deemed to have been first in making the current request for a card(s), the table has a number of game terminals. Each player has his/her own terminal. In one embodiment, the table has six game terminals, although any number of such terminals is feasible. Each game terminal includes a monitor or touch screen on which the player can view the player's own hand and use such information to make decisions related to continuing to play, including whether or not to request additional cards. The game terminals have their own input element(s) or unit(s) to allow players to make requests for cards when they are able to be activated or used to initiate a request. Each input element can be devised or implemented using one or more technologies, such as an implementation in which the touch screen monitor, or identified areas or sections thereof, has tactile input properties. After the player decides that she wants another card, she can touch the monitor, or a selected portion(s) thereof, using her finger or using some controllable device in order to input a card request. Other devices for making a card request could be provided including switch units separate from the monitor that, when enabled, can be activated by the player to generate the desired input or signal indicative of a card request.

The table also has a dealer terminal including a touch screen monitor on which cards dealt to or associated with the dealer are displayed. The apparatus or the table itself includes a computer or a control that supervises and manages game play among the players and the dealer. This control could be incorporated with the dealer terminal or may be provided separately from the dealer terminal, and could be housed or contained separately from the table. Card game play among the players and dealer, such as providing cards to them, is controlled by this control system, based on inputs or other information received from the player(s) and the dealer, in those implementations in which a dealer is employed rather than utilizing a completely automated dealer terminal.

The apparatus may also include an information display for providing various kinds of information to the players and/or dealer. Such information may include progressive, jackpot and/or side wager information related to the Blackjack type of game currently being played, as well as advertisements and/or other current game data.

Regarding play, essentially except for the order in which players are able to receive additional cards, the steps and rules associated with the modified Blackjack and Spanish 21, or other similar, games are basically the same as their conventional counterparts. More specifically, like conventional play, each player and then the dealer receives one card. Each player and then the dealer receive a second card. In other possible embodiments the dealer could receive his initial cards before the players or could receive the initial cards at virtually the same time by way of the computer or the control. These initial two cards dealt to each player are typically displayed face up using each player's user terminal. In addition, each user terminal could display all cards dealt to the other players, who are playing that round of the game. The providing of the initial two cards to the terminals of the dealer and the players is managed by the computer or control.

The player's ability to obtain any additional card after receiving the initial two cards is regulated by the player's input element(s). Whenever a player's particular input element is able to be activated, the player can request an additional card. In the preferred embodiment, each player's input element is disabled or not enabled, and cannot be activated, until all initial cards are provided or received. In one embodiment, one or more input elements are disabled or not enabled by not displaying on the touch screen monitor each such input element. Each such input element is enabled when it is being displayed on the video screen.

Unlike the conventionally played games, each player has the opportunity to be the first player to receive one or more additional cards. Each player requesting an additional card contacts or otherwise activates her input element. After at least one input element has been actuated, a determination is made by the control concerning which player's user terminal is deemed to be the first to request such a card. The control relies on information it receives in deciding which user terminal is to be provided an additional card. The information relates to one or more messages or requests that are generated using activation(s) of one or more input element(s).

In one embodiment, a polling operation can be used to determine which request from a particular player was found to be received first by the control. The polling operation basically involves checking for the presence of one or more input requests that might have been generated as a result of one or more players activating his/her input element based on the player's decision to continue to play the game by requesting at least one additional card. Based on the information obtained due to the polling when at least one input request is found, the control can determine which player is deemed to be the first to be provided an additional card. This is accomplished inasmuch as each user terminal involved with playing the game can be identified based on its unique connection to, or other association with, the control. Generally, because each polling operation that checks for the existence of an input request from each player is accomplished in less than about a millisecond, only one input request, assuming such a request was initiated, is typically determined as being present during each polling operation since the likelihood is substantially high that only one player's input request would be made during such a short time period. Consequently, the player determined to be the first to receive the particular additional card is usually the only player found to have provided an input request during that one millisecond or less polling operation. This polling-type embodiment is usually implemented when online versions of the modified games of the present invention are being played.

In another embodiment, a queuing, buffering or other storing process is utilized. For example, a single specific device driver of the control or computer is responsive to information received when one or more of a number of input elements is activated, such as related to a request for an additional card. Such a device driver can be specific to the touch screen monitors having one or more input elements that the players use in requesting additional cards or otherwise playing the game. That is, on a periodic basis, the specific device driver can check each of the touch screen monitors to see whether one or more of them has an activated input element. If so, information, a message or a request related to such activation is sent by the player's terminal having that activated input element to the specific device driver. This message is queued or otherwise stored in a memory that is associated with the specific device driver. Such a memory can also queue requests that might be generated using other video monitor(s). Regardless, the terminal whose request is placed first in the specific device driver memory queue is determined to be the first to receive the additional or next card. According to a variant of this embodiment, instead of a specific device driver that is responsive to all of the touch screen monitors of those players playing the game, each such monitor is associated with its own corresponding specific device driver. Activation of an input element eventually results in its request being stored with its own specific device driver. In connection with determining which player's input element's request is to be handled first, the control checks the memory of each specific device driver in a predetermined or desired order. Based on that check, the first memory found to have such a request has correspondence with the game terminal that is to receive the additional card. This queuing-type embodiment and its variant are typically found in games played with an actual or real table, such as in a casino.

These operations, such as involving a queue, polling, interrupts or other predetermined method(s), continue to occur as the round of the card game progresses and determinations continue to be made as to which player is to be provided the further additional card(s). Such steps continue until play is completed for all players at the table including when no player is to receive or is requesting any additional card, including play being completed for each player who has 21 using more than two cards or blackjack using the player's initial two cards. Play is also completed for one or more players whenever a predetermined time is exceeded or reached and such player has not indicated that he wants to play by, for example, not providing any input request for an additional card. Upon completion, the results are determined for all players including using the contents of the dealer's hand and which results can include one or more player hands busting or exceeding the card count of 21 and losing their wagers.

Regarding the online embodiment, the speed of play is increased using the same features related to players making requests by means of their input elements. Instead of using casino table terminals, players utilize their own available computer hardware and software, such as found in desktops, laptops, cell phones and/or any other control unit, to play the Blackjack type of games. These user terminals of the players communicate with a remote central control which, like the casino computer and/or control, oversees and controls game play including making determinations related to which players receives additional card(s), particularly the order by which cards are to be provided to the players.

In one or more online and/or actual table embodiments, players may have opportunities to receive tokens or other rewards that can be redeemed for prizes which are offered, such as various kinds of goods and services. Winning or receiving such rewards can be based on achieving a certain level of fast play. In the case of a casino, for example, the players and the casino could share in the results associated with faster play.

Based on the foregoing, the present invention advantageously enhances play for Blackjack and Blackjack-related card games, like Spanish 21. The speed of play of these games is increased since players are not required to wait for other players to finish before having the opportunity to receive one or more additional cards. Speed of play is also increased since players who have already completed their hands, on the average, do not wait as long as in conventional play for the remaining players to complete play and this occurs more often as the number of players at a particular table increases. Greater competitiveness among the players is introduced related to making requests for additional cards. No longer is play wedded to a definite player order, such as providing additional cards in a left-to-right direction relative to the dealer. Controls and determinations using the computer allow for greater flexibility and independence in the ways additional cards are provided to the card players.

Additional advantages of the present invention are readily apparent, particularly when taken together with following descriptions including the accompanying drawings.

DETAILED DESCRIPTION

Figure 1:
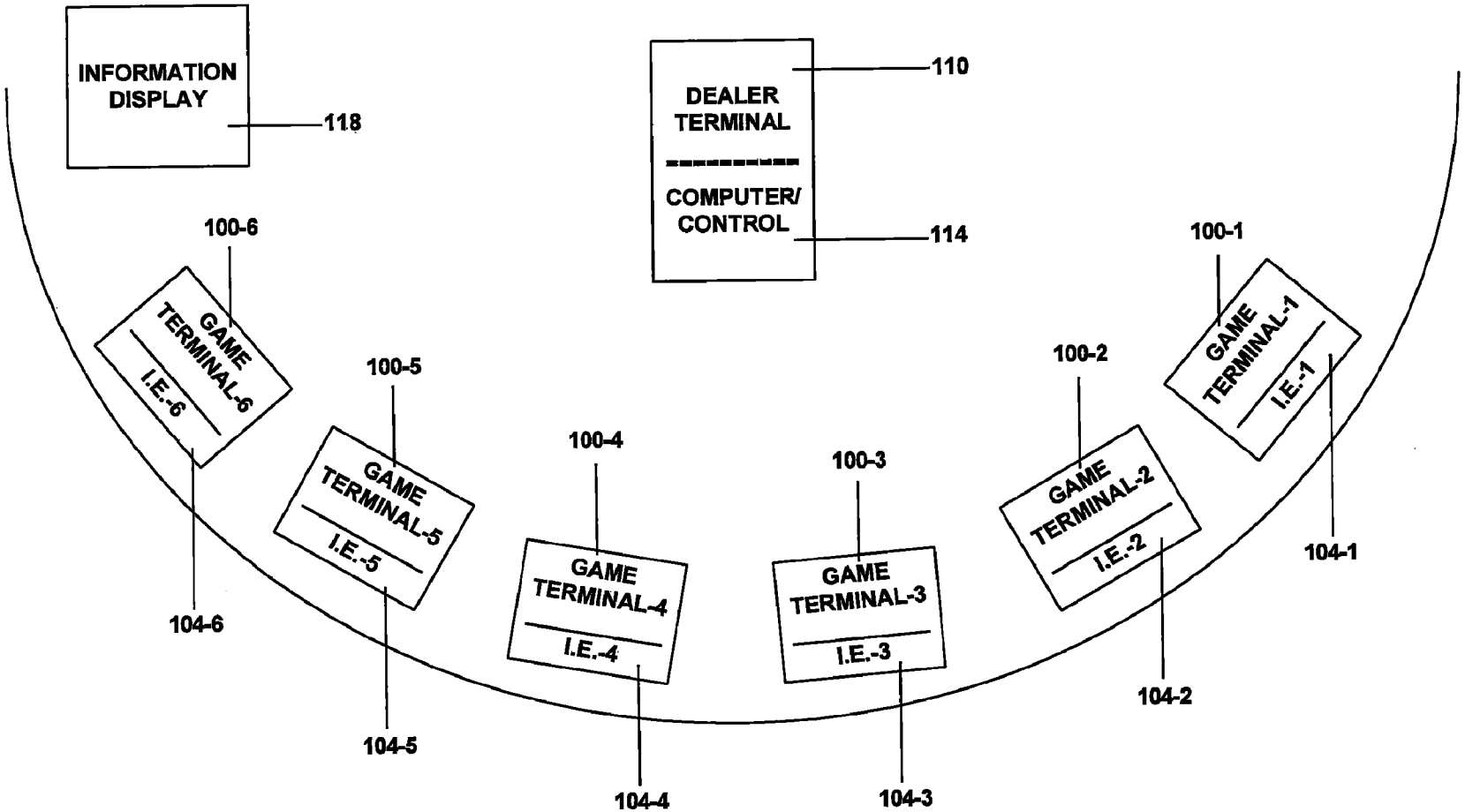
FIG. 1 is a block diagram that illustrates an embodiment using a table with six terminals for playing the modified Blackjack type card games of the present invention.
Figure 2:
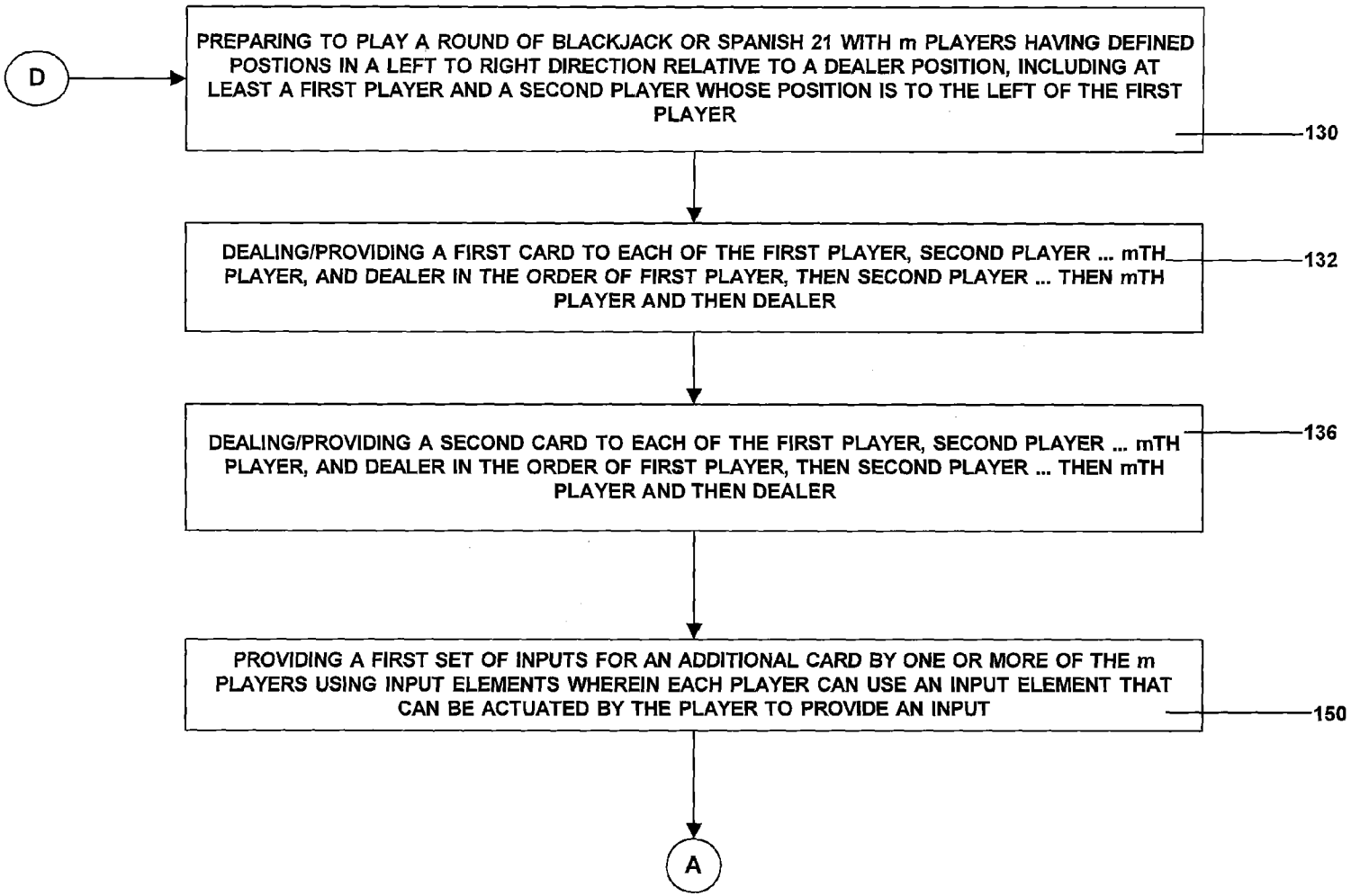
FIGS. 2-5 are flow diagrams illustrating basic steps or stages related to playing such card games.

With reference to FIG. 1, an apparatus for use in a casino table embodiment for playing Blackjack and Blackjack derived card games, including Spanish 21, of the present invention is diagrammatically illustrated. The apparatus includes a number of game or player terminals 100. The number of such terminals can vary, and with the embodiment shown illustrating game terminal-1 . . . game terminal-6, respectively having reference numbers 100-1 . . . 100-6. The game terminals can be comprised of conventional equipment including touch screen monitors, storage memory, processing hardware and software and/or input units. The game terminals 100 are supported or otherwise provided with a standard type of casino game table. Recessed or otherwise positioned terminals in a game table for playing one or more casino games have been devised and are commercially available. Some larger casinos currently utilize these terminal integrated tables in which more automated play has virtual, not real, card shuffling and dealing, which results in less players-dealer interaction.

Each of the game terminals 100-1 . . . 100-6 includes at least one input element-1 (i.e.—1) . . . input element-6 (i.e.—6), respectively, and identified using reference numbers 104-1 . . . 104-6. Such input elements 104 can be used by the game players to request additional cards when playing the card games. Although only one input element per player is illustrated in FIG. 1, more than input element 104 per player can be made available for use by the player. Additionally, other input elements 104 can be provided for use by the player to indicate that the player wants to terminate play, and not for the purpose of requesting one or more additional cards. The input elements 104 may comprise any number of devices that can be activated to initiate a signal, message or request particularly related to a player's desire for an additional card as part of playing a Blackjack type game. For example, each game terminal 100 preferably includes a touch screen monitor or other display for showing a player's current hand. Such a monitor, or at least some portion(s) thereof, can be configured to be responsive to a tactile input provided by the player whereby the player causes input element activation by touching a known portion of the screen. Other examples of input elements can include a keyboard, wireless device, computer mouse and/or a microphone that is responsive to audio inputs and relies on voice-activated software, some or all of which can be part of each game terminal 100. In addition to the input element 104 for use in generating inputs related to additional card requests, each game terminal may include devices or more input elements that can be actuated by the player to indicate that the player is: (a) splitting pairs and/or (b) doubling down. The player may choose to "split pairs" when the player's two initially dealt cards are numerically the same. In such a case, the player chooses to treat these two initial cards as two separate hands. The player may choose to "double down" after looking at his initial two cards. When doubling down, the player doubles his bet and usually is able to receive only one additional card, although in Spanish 21 it is possible to double down more than once. The player may also be able to choose to split pairs and then after splitting double down in the same hand. Each game terminal 100 also typically includes processing hardware and/or software for enabling the computerized game playing.

The apparatus also includes a dealer terminal 110 for handling the dealer's cards. Like the game terminals 100 of the players, the dealer terminal 110 typically includes a touch screen monitor or other video unit for displaying the dealer's cards. This terminal 110 could also include other input and/or output devices, such as a keyboard, computer mouse, wireless unit, a microphone and/or speakers. Additionally as an integral part of or, alternatively, provided separately from the dealer terminal 110, is a control system or computer unit 114. The control 114 includes the necessary processing hardware and software for implementing the computerized card games. The control 114 also has device drivers that enable desirable communications to occur involving the game terminals, particularly in connection with input requests from the input elements 104 related to requests for additional cards and/or related to other player-related requests or information as part of playing the card games. Such a device driver is responsive to messages or signals generated by one or more of the input elements 104 for use in determining whether one or more input requests was provided by one or more input elements 104 and for use in determining, whenever more than one request was provided during a particular time period, which of such requests should be found or otherwise deemed to be first. In one embodiment, the dealer terminal 110 is used, operated, or monitored by a dealer who is present while the game is being played. In another embodiment, no dealer is present while the game is being played; however, the game players are able to see the dealer cards generated using the dealer terminal video unit.

As illustrated in the FIG. 1 embodiment, the apparatus may also include an information display 118 for presenting or displaying predetermined information designated by the casino game provider and which can easily be seen by the game players with minimal distraction. Such displays can be in the form of programmable video streams of text, images and/or graphics that might be related to game or other promotional items intended to benefit the provider's business, data related to game play, and information that may be of interest or entertaining to the game players and/or game observers. The contents of the information display 118 can be controlled using the dealer terminal control 114 or some other control/central computer system utilized by the casino game provider or owner.

Referring now to FIGS. 2-5, as well as FIG. 1, descriptions are next provided related to playing the games of the present invention. These figures outline fundamental stages or steps associated with aspects of game play. As depicted using block 130, a number of players (e.g. "m" players) are involved in playing a round of a Blackjack type game. According to the FIG. 1 embodiment, "m" can be up to six players at the table, although in other embodiments the number of players can be more or less than six. The "m" players are located at a table for playing the game. They can be defined as being positioned from a left-to-right direction relative to the dealer and/or the dealer terminal 110. In accordance with traditional or conventional play and after initial cards are dealt or provided to the dealer and all players, game play continues starting with the player positioned to the leftmost of the dealer (from the perspective of the dealer or the dealer terminal 110) and continuing with players in order in a left-to-right direction. Regarding the initially dealt cards, blocks 132, 136 indicate that two cards are initially provided to each of the "m" players. In this embodiment, the first player is leftmost of the dealer, the second player is to the immediate left of the first player and the mth player is to the immediate left of the m−1th player. And, for this embodiment, these two initial cards are provided at different times to each of the "m" players and then to the dealer. More specifically, a first card is dealt to each of the players and the dealer, starting with the first player, continuing with the other players until the mth player receives his first card, and then a first card is dealt to the dealer (block 132). Subsequently, a second card is dealt to the players and dealer in the same order as the first card (block 136). However, the initial two cards to the game terminals 100 and the dealer terminal 110 could be provided in any order or essentially simultaneously.

After all player terminals 100 and the dealer terminal 110 have received their initial two cards, for players who want at least a first additional card, steps are conducted related to requesting such an additional card. As indicated by block 150, at least one of the "m" players wants an additional card. Each player requesting the additional card is intending to use that card to help him or her beat the dealer's hand. Each of any such players wanting an additional card uses the player's input element 104 to initiate such a request. That is, such a player actuates his or her input element 104 by, for example, touching a particular portion or section of that player's game terminal touch screen monitor. As a result of at least one player actuating the player's input element 104, a set (e.g., first set) of inputs is provided. Each such input constitutes a signal or message being generated as an input request for an additional card, or additional cards in the case of a split. Generally, a set of inputs that are provided or generated at one instance in time includes only one input request from one game terminal 100. It would be very rare that more than one player generated an input request at the same time or at virtually the same time.

Figure 3:
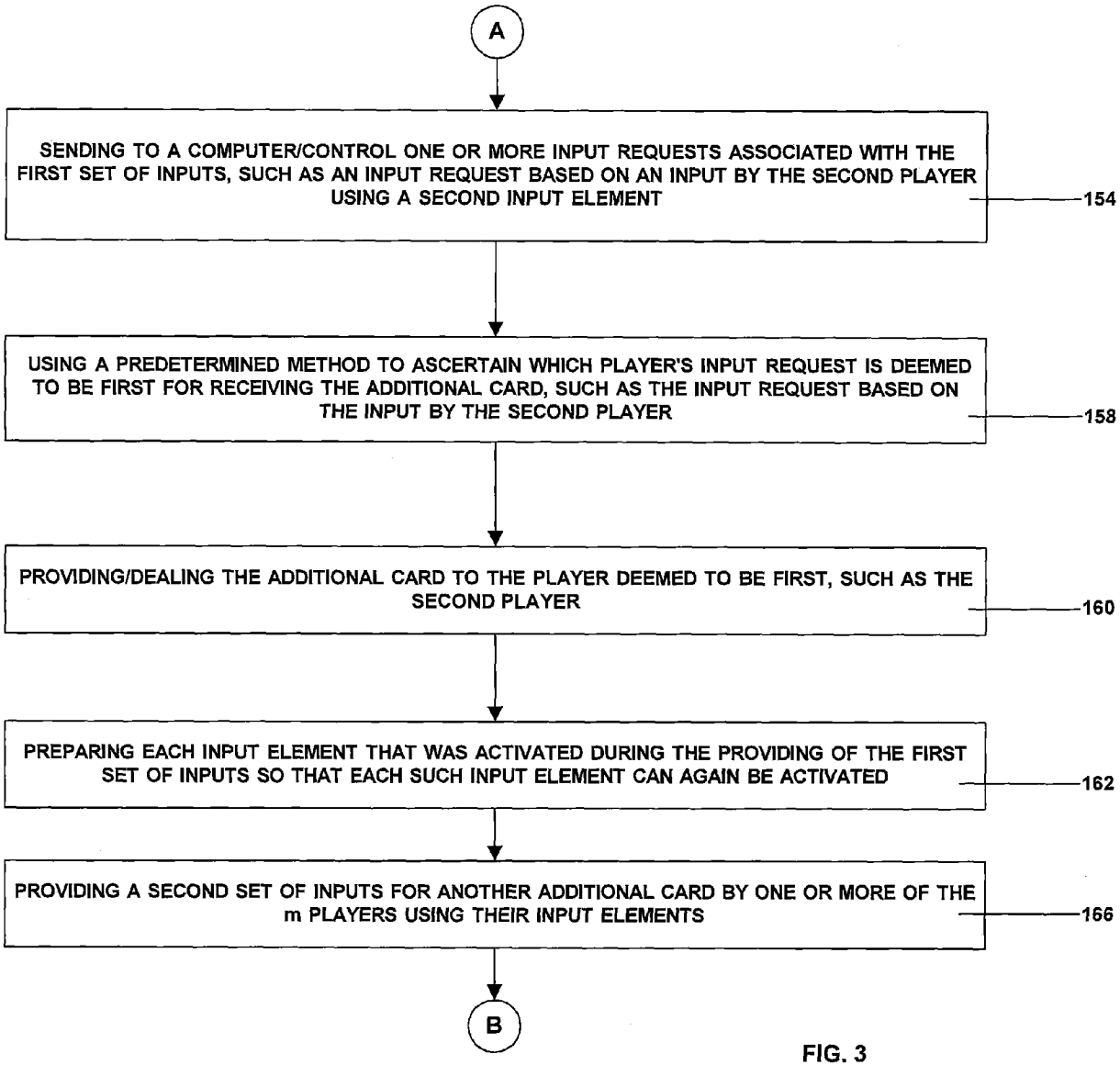

The first set of inputs from the one or more input elements 104 associated with the players is received by the control or computer 114, as noted by block 154 of FIG. 3. Per block 150, at least one of the players started/controlled the generation of an input request for an additional card. And, as recited in block 154, at least the second player did initiate such a request. According to this described embodiment, the second player is positioned immediately next to the first player, who is the leftmost player relative to the dealer/dealer terminal.

Block 158 refers to the determination or finding concerning which of the "m" players is to receive this first additional card. In conjunction with this particular embodiment, the computer 114 checks the contents of the memory of a specific device driver that is part of, or associated with, the computer 114. The specific device driver has certain response or interaction capabilities with predetermined devices, such as the touch screen monitors of the game terminals 100. That is, the specific device driver's associated memory stores information related to the requests or messages resulting from activation(s) of input element(s) 104 that are part of the touch screen monitor(s). Such information is stored or queued in the order it is deemed to have been received using the computer's operating system. Basically, the first information stored is used to determine which of the game terminals is deemed first to receive an additional card, in the case in which such information is directed to an additional card request. In the case of the first set of input requests having only an input request from the second player's user terminal, the specific device driver associated memory will have stored this request first. Consequently, such information stored or queued first in that memory leads to a determination that the first additional card is to be provided or dealt to the second player. In the case of the first set of input requests including input requests from one or more players, in addition to the second player, a check of such memory also leads to a finding, in this example or embodiment, that the second player input request is deemed to be first by the dealer terminal control or computer 114. Where the second player is found to be the first requestor, based on the first set of inputs, the additional card is provided or dealt to that player, even though the player located at the dealer's leftmost position is not the second player and the player located in the leftmost position may want an additional card.

With regard to controlling the timing of input element 104 activation(s), a particular input element 104 cannot be subsequently actuated by its associated player until after it is enabled for player actuation. Control of such enablement is maintained apart from the player, such as by means of the dealer terminal control 114, so that a player is unable to repeatedly actuate his or her input element 104 in order to request more cards, when the player's input element 104 has not been controllably enabled. Such enabling/disabling of any input element 104, in one embodiment, is accomplished by displaying the input element when it is enabled or can be activated and not displaying the input element when it is disabled or not able to be activated. In such an embodiment, the input element is displayed once again essentially immediately after or about the same time that the player received the requested card. This procedure is outlined in block 162. Each input element 104 that was activated in conjunction with the first set of inputs can once again be enabled or prepared for possibly another actuation by the player having that input element 104. Concerning the example of at least the second player providing an input request as part of the first set of input requests, that player's input element 104-2 was disabled or not ready for another actuation until controllably enabled once again, using the dealer terminal control 114 or another appropriate control. Preferably, such input element preparation or enablement occurs after the additional card is provided to the player deemed to be first for receiving this additional card. In the example where only the second player provided an input request as part of the first set of input requests, no other player's input element 104 was disabled based on the first set of input requests, although other players' input elements might be later disabled based on subsequent one or more sets of input requests. Parenthetically, it is noted that a player's input element 104 is also disabled when the player has blackjack or 21 based on the player's initial two cards.

With reference to block 166 and continuing with this example directed to game methodology, a second set of inputs (again, typically including only one input request from one game terminal 100) is generated related to another additional card being requested. As an overview, one or more players continue to want one or more additional cards as part of the objective to beat the dealer's hand. As briefly described using block 170 of FIG. 4, this second set is received by the dealer terminal computer or control 114 and includes an input request from the first player. Like the first set of inputs and referring to block 174, a determination is made related to which player is to receive this particular additional card.

Based on this example, it is found that the first player will receive the card and, as denoted in block 178, the another additional card (e.g., a second additional card) is provided to the first player. The determination that this another additional card is to be provided to the first player is based on the queuing operation using the specific device driver associated memory in connection with the first player's input request. This determination involves associating the request with the input element 104-1 that triggered it. Additionally, it may be, and is more than likely, that the first player's input request was generated very close in time after the second player's input request that was part of the first set of input requests. However, even an extremely small time difference between input elements 104-2 and 104-1 being actuated can result in a different set of input requests and, correspondingly two different requests being queued or stored using the afore-described specific device driver. Preferably, such a small time difference can be defined one way as: the second set of inputs, including the first input by the first player (in this example), is provided to the dealer terminal control 114 before the dealing or providing of the additional card to the second player is completed (e.g. additional card is located in a position where it's not moving on the touch screen monitor of the second player's game terminal 100-2), pursuant to the first set of inputs. Typically also, the second set of inputs is provided before the input element 104-2 of the second player is enabled again for possible activation. In one embodiment or example, the second set of inputs is provided less than five seconds, and preferably less than one second, after the first set of inputs is provided. Even in the very rare instance in which input requests from two or more players are produced "simultaneously", the queuing operation (which request is stored or provided first in the specific device driver associated memory) results in a determination regarding which of such input requests is deemed to be first. Block 182 related to the second set of inputs is comparable to block 162 related to the first set of inputs in that the input element 104-1 associated with the first player can be enabled again in the event that the first player is able to request yet another card and the player wants to do that.

Figure 4:
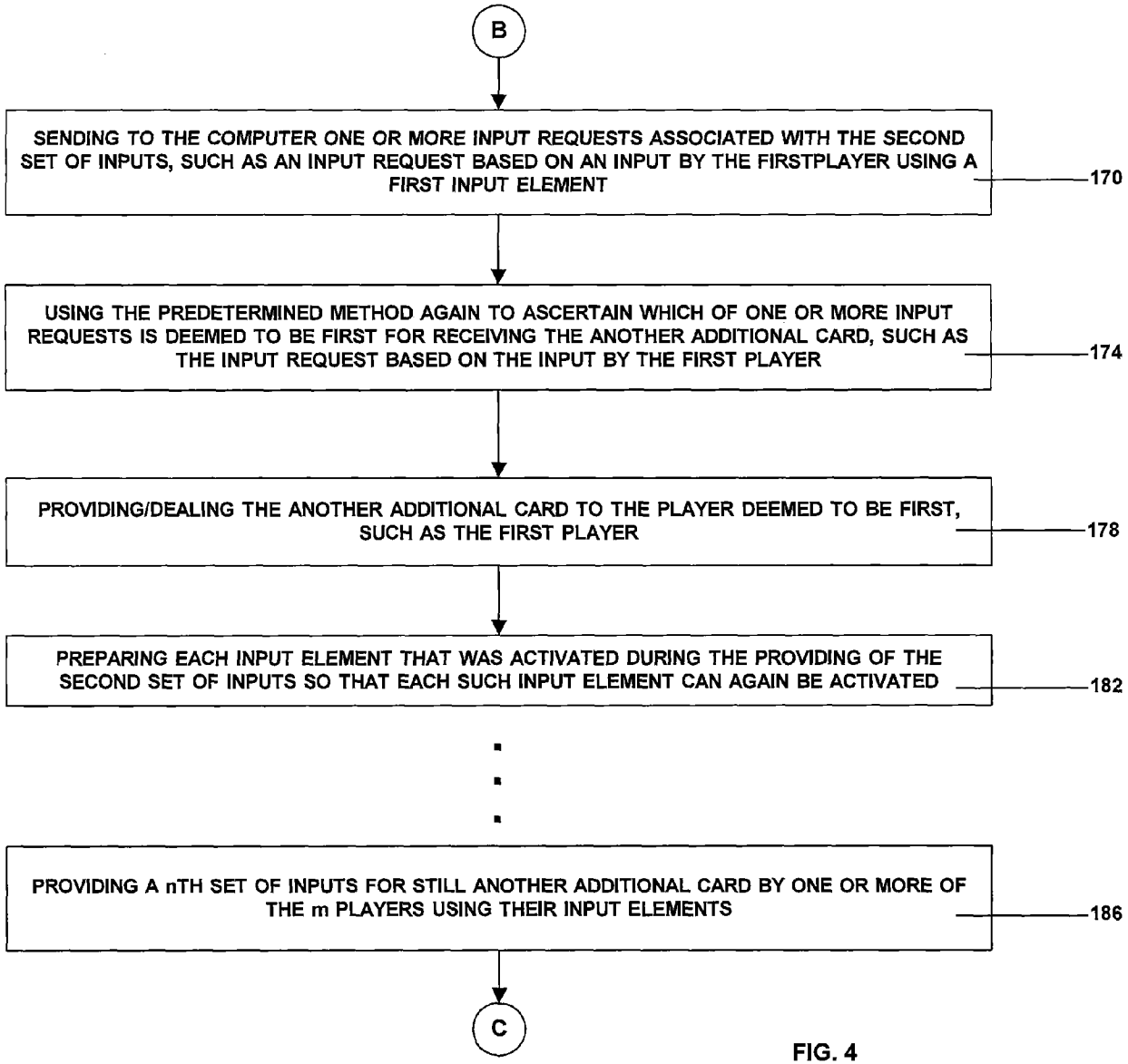
Figure 5:
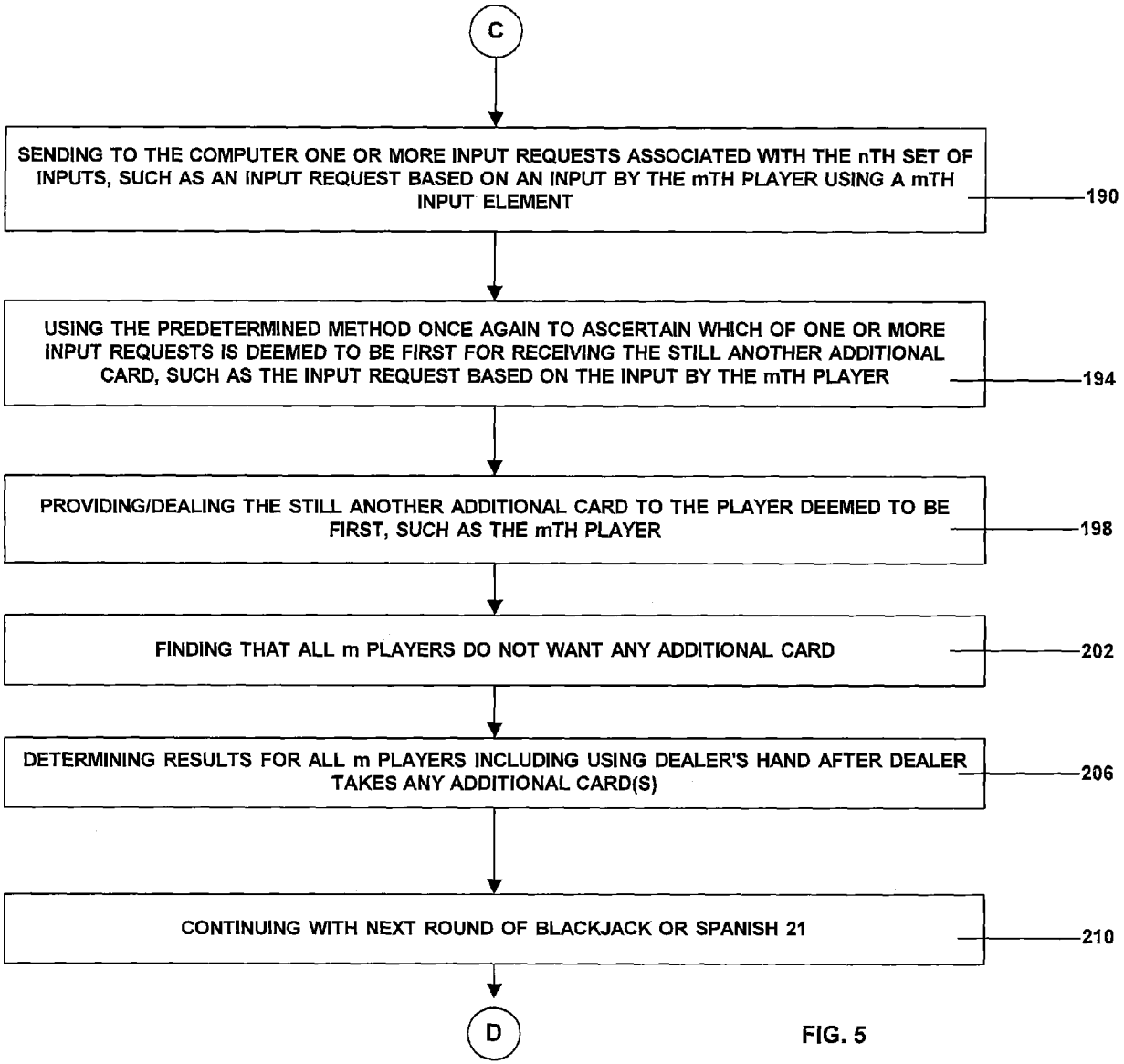

The processes and steps related to requests for any additional cards continues, as described above, until a final or nth set of inputs is generated by one or more players, as set out in block 186 of FIG. 4. This nth set is received by the dealer terminal computer 114, like all other sets of inputs. Reflected by the example indicated in block 190 of FIG. 5, this nth set includes an input request based on an input request by the mth player using the mth input element **104-*m*, which could be the sixth player using the sixth input element 104-6 or could be any other player in other examples. This is considered to be the last input request for this particular round of the card game. This last input request is received and identified using the previously described queuing process, as noted in block 194. According to the example being illustrated by FIGS. 2-5, the input request received is that initiated by the mth player, who is dealt the still another additional card pursuant to that player's request and which is indicated by block 198**.

Regarding completion of play by each of the players playing a round of the game, in one embodiment, there are different ways by which this can be achieved. For each player, there can be a number of input elements that can be used or activated by that player, in which use or activation by the player, under one or more circumstances, results in the player completing play. Such a group of input elements for use by each player can include the following having the accompanying identifier: "quit"—the player activates this input element to indicate that she or he, for whatever reason, has decided to stop playing the game; "stand"—the player activates this input element to indicate that the player does not want any more cards; "hit"—the player activates this input element to request another card but, in the case in which the requested card causes the player's hand to bust, such activation effectively results in play termination for that player for that round; "splitting pairs"—the player activates this input element to indicate that the player wants to treat his or her initial two cards as two separate hands but, when playing Blackjack and in the case in which such split cards are two aces, such activation effectively results in play termination since the player can only receive one additional card for each of the two separate hands according to typical rules and so after activation the player is not able to continue receiving any more cards (such termination result does not apply in Spanish 21); "double down"—the player activates this input element when the player wants to double her or his bet but, under usual rules, the player is entitled to only one more card when doubling down and so such activation effectively results in discontinuance of play for that player; and "surrender"—the player activates this input element when the player concludes that she is not likely to win but will retain ½ of her initial wager, and such activation is typically allowed only after the dealer ascertains that he does not have blackjack and before the player elects to take any additional card. Another way that play is terminated for the player relates to player delay. After a predetermined time during which the player has not taken any action to indicate that he or she is playing the game, the computer or control 114 no longer enables at least certain input elements for the player, thereby effectively preventing the player from making any card request or otherwise prevents the player from activating any such input elements.

In the embodiment having such a group of input elements for each player, certain of such input elements are used to request additional cards. The player can activate the "hit" input element to request one or more additional cards so long as his hand does not bust. The player can continue to request one or more additional cards using the "hit" input element after splitting pairs, when the cards being split are not two aces, so long as the player's hand does not bust. The player can request one or more additional cards using the "double down" input element after doubling down once, when playing Spanish 21 where "double-double down" is allowed so long as the player's hand does not bust.

In conjunction with all players in this round of the game having any and all additional cards wanted or requested and there not being any further input request related to an additional card, a finding is made to that effect as indicated by block 202, such as by means of the dealer terminal control 114. With all play by the players completed, player results are determined for all m players including using the dealer or dealer terminal hand after taking any additional card(s), as conveyed by block 206, such as the dealer taking cards until his hand is complete according to game rules. Basically, as in conventional Blackjack or Spanish 21, for example, determinations are made related to which player(s) do not lose all their bet including where one or more players beat the dealer hand and receive a return based on the amount of their bet or where a player's wager, or a part thereof, is returned to him/her, such as when there's a "push.". The results of at least some side or ancillary bets can also be determined at this time. Other side bets can be or are determined at the outset of the hand, before players are required to make any decisions. Referring to the last block 210 of FIG. 5, another round of the card game Blackjack or Spanish 21 can then be played by the same or different players. The next round is played utilizing the inventive features like that just described including beginning with block 130.

Figure 6:
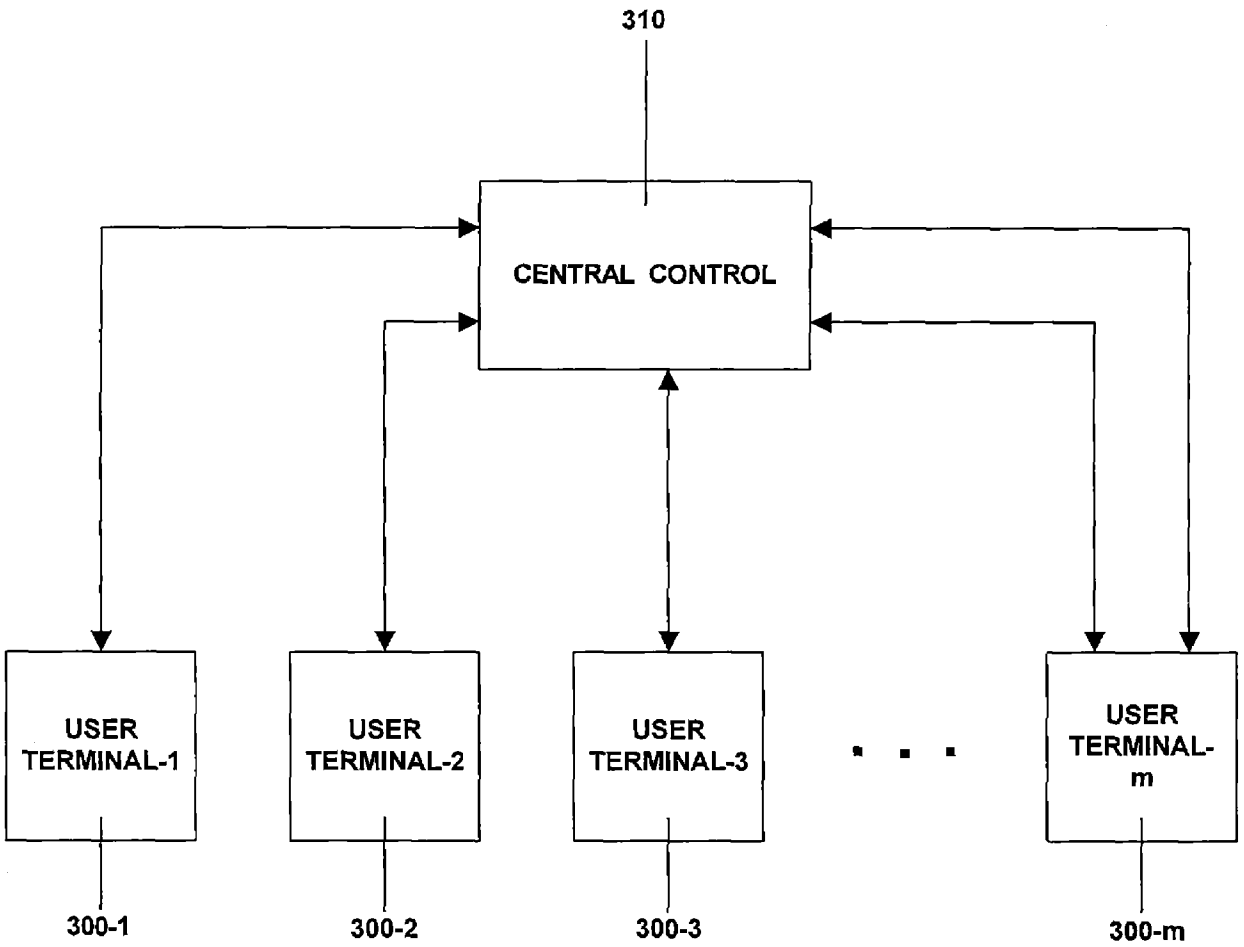
FIG. 6 is a block diagram representative of an online embodiment for playing the modified Blackjack type card games of the present invention.
Figure 7:
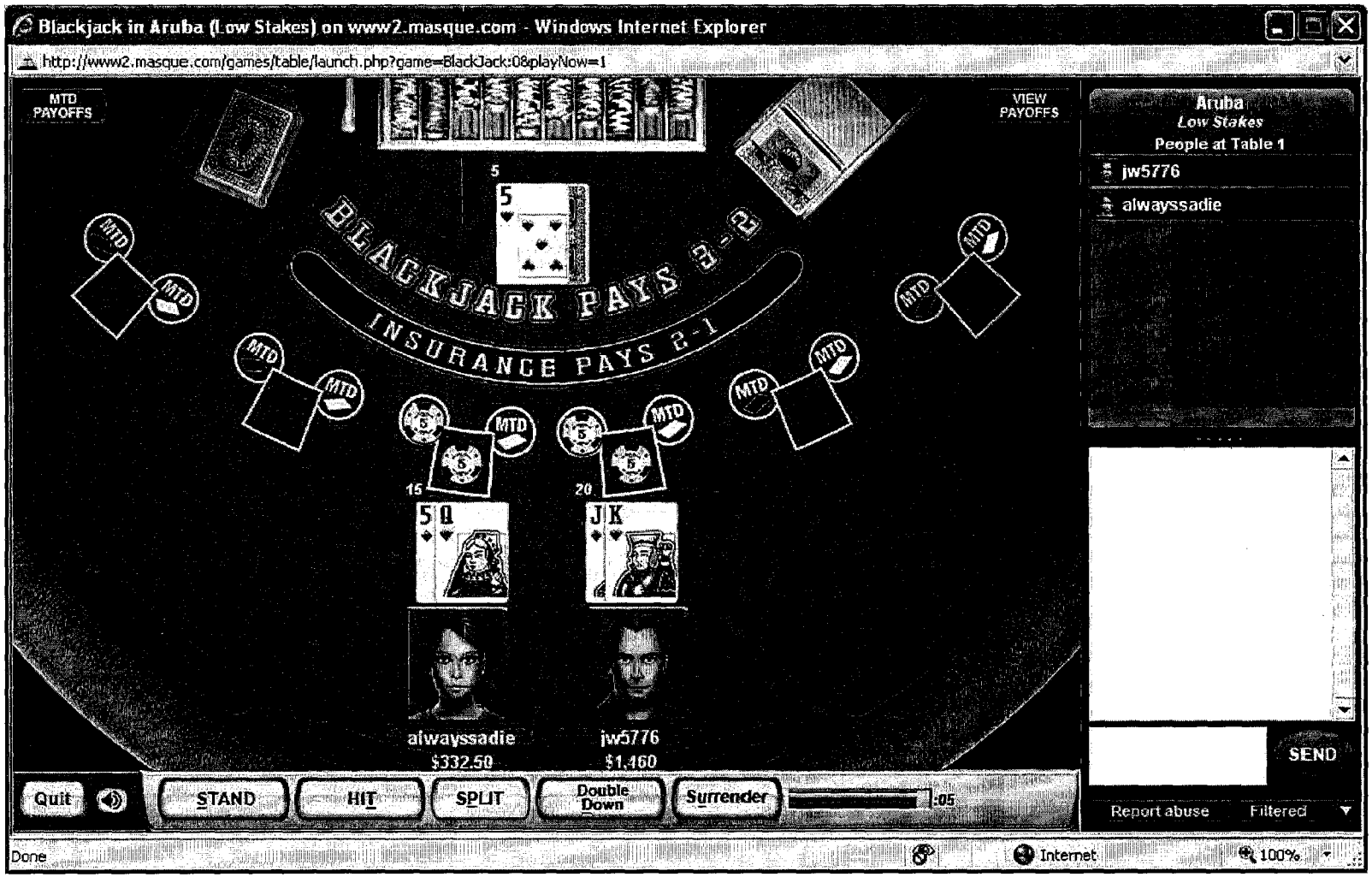
FIG. 7 illustrates a screen shot displaying different identified input elements in which such elements are used to request one or more cards and/or are used as part of game play including terminating game play.

In addition to playing the modified Blackjack type card games in a casino setting or other local setting, players can play these games remotely or online, and they can be played using actual/real money or not. A basic depiction of an online embodiment is diagrammatically shown in FIG. 6. As illustrated, the apparatus of this embodiment includes a number of user or client terminals 300, such as user terminals 1 through m (user terminal-1 . . . user terminal-m). Each of these user terminals 300 is operated or used by a player playing the modified card game(s). The user terminals 300 can be comprised of currently or later available hardware and software, including desktop, laptop, notebook, and/or hand-held computers with appropriate software, as well as capable portable communication devices. The apparatus also includes a central control 310 that is able to communicate with each of the user terminals 300. Like the dealer terminal 110 and its control 114, the central control 310 has responsibility for managing or controlling game play in the ways previously described in connection with the control 114. That is, the central control 310 handles, or is otherwise involved with similar or the same functions conducted by the dealer terminal control 114 including: providing initial cards to the players, receiving/making determinations/responding to player generated input requests, including those generated using input elements previously described, such as the "quit", "stand", "hit", "splitting pairs", "double down" and "surrender" input elements, such as depicted in the screen shot illustration of FIG. 7; regulating enabling/not enabling the player's ability to initiate an input request; finding that there are no more input requests; and settling the results of each particular round of the game. The game methodology, stages, steps and/or procedures for the online version are comparable to those described in connection with FIGS. 2-5.

With respect to relying on information, such as requests, or messages having requests, that were generated by activation of one or more input elements and sent to the central control 310, a polling method involving the accessing of memories is utilized. That is, the central control 310 conducts a poll of the contents of each memory that has correspondence with a particular one of the user terminals 300. Each user terminal 300 has its own associated or corresponding memory in the central control 310 that is polled. When an input element of a particular user terminal is activated, information resulting therefrom is subsequently stored in a memory located in the central control 310 that is related to that particular user terminal. The polling occurs at predetermined intervals to check whether or not an input request was received from one or more user terminals 300. Such a poll or check might take place every predetermined number of microseconds, such as by way of example only, in the range of every 0.01-0.1 millisecond. The poll is conducted using the central control 310 that responds to the incoming signal(s)/message(s) representing the input request(s) comprising a first set of input requests. In the case of the first set of input requests having only an input request from the second player's user terminal, the polling leads to a determination that the first additional card is to be provided or dealt to the second player. In the case of the first set of input requests including input requests from one or more players, in addition to the second player, the polling leads to a finding, in this example or embodiment, that the second player input request is deemed to be received first by the central control 310. This finding could be based on a poll conducted such that, relative to the other input request(s), a check for the second player's input request was conducted first. On the other hand, if a check of another player's input request had been made first, that player's request may have been deemed to be first and entitled to the first additional card, not the second player. Accordingly, the finding that the second player's input is deemed to be first may be arbitrarily based on the order that the poll was taken (second player's input was polled before another player's input, instead of reversing that order). Because of the relatively short time period between polls (milliseconds or less), however, it is highly likely that the typical case will involve only one player's input request in any one set of requests. That is, it would be an extremely rare case for there to be more than one input request present during any one particular poll so that, whenever an input request is present it is typically the only one. Where the second player is found to be the first requestor, based on the first set of inputs, the additional card is provided or dealt to that player, even though the player located at the dealer's leftmost position is not the second player and the player located in the leftmost position may want an additional card.

As should be appreciated, it may be, due to a particular user terminal's capabilities and performance, including its interactions with the network(s) in communication with the central control 310, that its request for an additional card even though made before another user terminal could be deemed to occur after that terminal. Consequently, one or more additional cards might be provided depending on the capabilities of one user terminal in comparison with another user terminal. It should also be understood that procedures including algorithms could be utilized to eliminate or overcome such occurrences, if necessary or desired. The Blackjack and Blackjack-related games, like Spanish 21, described herein can be played from one or more online game sites and can be launched using the computer browsers available to the players and which game site can include player lobbies and virtual tables, together with required player authorizations and/or authentications.

The foregoing discussion of the invention has been presented for purposes of illustration and description. Further, the description is not intended to limit the invention to the form disclosed herein. Consequently, further variations and modifications commensurate with the above teachings, within the skill and knowledge of the relevant art, are within the scope of the present invention. The embodiments described hereinabove are further intended to explain the best modes presently known of practicing the invention and to enable others skilled in the art to utilize the same as such, or in other embodiments, and with the various modifications required by their particular application or uses of the invention. It is also intended that the claims be construed to include alternative embodiments to the extent permitted by the prior art.

What is claimed is:

1. A method for playing a computerized card game with a number of players including at least first and second players, comprising:

providing at least first and second input elements;

providing a control that is in communication with at least said first and second input elements;

providing at least a first card to a first player;

providing at least a first card to a second player;

providing a first set of inputs by one or more of the players, including a first input being provided by the second player using said second input element, related to a request for a first additional card;

deciding that said first additional card is to be provided to the second player using said first set of inputs and said control; and providing said first additional card to the second player;

wherein a second additional card is provided to the first player using said control after said first additional card is provided to the second player, and a third additional card is provided to the second player using said control after said second additional card is provided to the first player.

2. A method of claim 1 wherein a second set of inputs, including a first input associated with the first player, is provided less than one second after said first set of inputs.

3. A method of claim 1 wherein said first set of inputs includes a first input from only the second player.

4. A method of claim 1 wherein the second player is not required to wait for the first player related to said first additional card before said providing said first additional card to the second player.

5. A method of claim 1 wherein said second additional card is provided to the first player using an input provided by the first player related to a request for said second additional card and said third additional card is provided to the second player using another input provided by the second player related to a request for said third additional card.

6. A method of claim 5 wherein said input provided by the first player is included in a second set of inputs and said another input provided by the second player is included in a third set of inputs.

7. A method of claim 1 wherein, in conventional play of said card game when the first player wants said first additional card, said first additional card is required to be provided to the first player.

8. A method of claim 1 wherein said card game is a blackjack type game, said providing at least said first card to the first player includes providing said first card and a second card, said providing at least said first card to the second player includes providing said first card and a second card, and in which said first set of inputs is provided after said providing of said first and second cards to the first and second players.

9. A method of claim 1 wherein the first and second players are in definable positions relative to each other with the second player's position being to the left of the first player's position and in which the number of players includes a third player, and wherein a fourth additional card is provided to the third player before said third additional card is provided to the second player.

10. A method of claim 1 wherein said first input element includes at least one of: at least a portion of a touch screen monitor, a keyboard, a wireless device, a computer mouse and a microphone that is responsive to audio inputs.

11. A method of claim 1 wherein a fourth additional card is provided to the first player after said second and third additional cards are provided, said second, third and fourth additional cards being provided based on a second set of inputs, a third set of inputs, and a fourth sets of inputs, respectively.

12. An apparatus for playing a card game by a number of players, comprising:

a plurality of terminals including at least first and second terminals for use by first and second players, respectively, said first and second terminals including a first input element and a second input element, respectively; and a control communicating with each of said plurality of terminals, said control being used in providing at least a first card to the first terminal and a second card to the second terminal after said first card is provided to the first terminal;

wherein at least a first set of inputs is provided by one or more players, including by the second player using said second input element, related to requests for first additional card and a second additional card, with said control determining, using said first set of inputs, that said first additional card is to be provided to said second terminal, and said control determining that said second additional card is to be provided to said first terminal after said first additional card is provided to the second terminal.

13. An apparatus of claim 12 wherein a second set of inputs, including a first input associated with the first player, is generated less than one second after said first set of inputs is provided.

14. An apparatus of claim 12 wherein said first set of inputs includes an input provided only by said second terminal second input element.

15. An apparatus of claim 12 wherein said second terminal has a position that is to the left of a position of said first terminal.

16. An apparatus of claim 12 wherein saga second set of inputs is provided and said control determines that said second additional card is to be provided to said first terminal using said second set of inputs.

17. An apparatus of claim 12 wherein said terminals are located remotely from each other and said control is located remotely from said terminals.

18. An apparatus of claim 12 wherein said terminals are adjacent to each other and disposed in a table.

19. An apparatus of claim 12 wherein at least one of said input elements is one of: (i) at least a portion of a touch screen monitor and (ii) located separately from said touch screen monitor.

20. A method for playing an electronic card game involving at least first, second and third players, with each player being in a definable position relative to the other players including the second player's position being to the left of the first player's position and the third player's position being to the left of the second player's position, comprising:

providing a plurality of input elements;

providing a control that is in communication with at least one of said input elements;

providing at least a first card to the first player;

providing at least a second card to the second player;

providing at least a third card to the third player;

providing an additional card, including one of first, second and third additional cards, to each of the first, second and third players after at least said third card is provided using said control that is used in determining an order that said first, second and third additional cards are provided, wherein said control is responsive to inputs associated with said plurality of input elements and in which said first, second and third additional cards are provided, in an order different than the order that said first, second and third cards are provided.

21. A method of claim 20 wherein said first additional card is provided to the second player, said second additional card is provided to the third player after said first additional card is provided to the second player, and said third additional card is provided to the first player after said second additional card is provided to the third player.

22. A method of claim 20 wherein said first additional card is provided to the third player, said second additional card is provided to the first player after said first additional card is provided to the third player, and said third additional card is provided to the second player after said second additional card is provided to the first player.

23. A method of claim 20 wherein at least one of said inputs is generated using one of said plurality of input elements that is activated by one of the players.

24. A method of claim 20 wherein said first input element includes at least one of: at least a portion of a touch screen monitor, a keyboard, a wireless device, a computer mouse and a microphone that is responsive to audio inputs.

* * * * *